US012467462B2

(12) United States Patent
Nieforth et al.

(10) Patent No.: US 12,467,462 B2
(45) Date of Patent: Nov. 11, 2025

(54) COMPRESSOR ASSEMBLY INCLUDING A FLOW-RESTRICTING VALVE

(71) Applicant: CARRIER CORPORATION, Palm Beach Gardens, FL (US)

(72) Inventors: Scott A. Nieforth, Clay, NY (US); Vishnu M. Sishtla, Syracuse, NY (US); Michael Bergin, Palm Beach Gardens, FL (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 53 days.

(21) Appl. No.: 17/973,043

(22) Filed: Oct. 25, 2022

(65) Prior Publication Data

US 2023/0151818 A1 May 18, 2023

Related U.S. Application Data

(60) Provisional application No. 63/279,781, filed on Nov. 16, 2021.

(51) Int. Cl.
*F04D 15/00* (2006.01)
*F04D 29/00* (2006.01)

(52) U.S. Cl.
CPC ..... *F04D 15/0005* (2013.01); *F04D 29/002* (2013.01)

(58) Field of Classification Search
CPC ..... F04D 15/0005; F04D 27/0292; F04D 29/002; F04D 29/058; F04D 29/4206; F04D 29/464; Y10T 137/778; Y10T 137/7779; F16K 17/26; F25B 1/053; F25B 1/10; F25B 2500/12; F25B 2600/0261; F25B 2600/2521; F25B 31/008; F25B 31/026; F25B 41/22; F25B 49/022; F25B 49/025
USPC .... 417/26, 356, 902, 410.5, 310; 137/493.8, 137/493.9, 493; 418/55.1; 62/508, 505
See application file for complete search history.

(56) References Cited

U.S. PATENT DOCUMENTS 919,036 A * 4/1909 Langer ..... F16K 15/1401 137/902
2,324,434 A * 7/1943 Shore ..... F25B 31/026 417/372

(Continued)

FOREIGN PATENT DOCUMENTS

EP 1698784 B1 3/2013
JP S58172482 A 10/1983
JP 2002349458 A 12/2002

OTHER PUBLICATIONS

Extended European Search Report for Application No. EP 22 20 7755 dated Apr. 11, 2023.

*Primary Examiner* — Mark A Laurenzi
*Assistant Examiner* — Benjamin Doyle
(74) *Attorney, Agent, or Firm* — Carlson, Gaskey & Olds, P.C.

(57) ABSTRACT

An illustrative example embodiment of a compressor assembly includes a compressor housing having a suction inlet and a discharge outlet. A flow restricting valve allows unrestricted fluid flow in a first direction into the housing through the suction inlet and out of the discharge outlet during a first operating condition. The flow restricting valve allows a restricted fluid flow in a second, opposite direction into the housing through the discharge outlet in a second operating condition.

21 Claims, 1 Drawing Sheet

(56) References Cited

U.S. PATENT DOCUMENTS 2,898,032 A * 8/1959 Katzenberger ..... F04C 29/0085 418/175
3,811,466 A * 5/1974 Ohringer ..... F16K 15/1471 137/493
4,410,006 A * 10/1983 Moulton ..... F16F 9/348 137/854
4,714,416 A * 12/1987 Sano ..... F04B 39/1073 137/856
4,840,545 A * 6/1989 Moilanen ..... F04C 28/28 417/301
4,951,701 A * 8/1990 Boehmer ..... F04B 53/06 137/493.9
5,267,452 A * 12/1993 Zinsmeyer ..... F04D 29/063 62/505
5,531,577 A * 7/1996 Hayase ..... F01C 21/102 417/410.5
5,579,651 A * 12/1996 Sugiyama ..... F04C 23/008 62/508
5,800,141 A * 9/1998 Ceylan ..... F04C 28/28 418/270
5,857,348 A * 1/1999 Conry ..... F04D 29/023 417/423.12
6,138,778 A * 10/2000 Price ..... E21B 10/24 137/493.9
6,213,732 B1 * 4/2001 Fujio ..... F04C 29/068 181/403
6,302,138 B1 * 10/2001 Sumrall ..... B60C 29/06 137/493.9
6,881,041 B2 * 4/2005 Lee ..... F04C 18/3568 418/162
7,338,265 B2 * 3/2008 Grassbaugh ..... F04C 28/265 418/270
10,072,659 B2 * 9/2018 Sun ..... F04C 28/24
2004/0071570 A1 * 4/2004 Dreiman ..... F04B 39/0261 417/410.3
2008/0178948 A1 * 7/2008 Wilmshurst ..... F16K 15/04 137/513.5
2008/0260539 A1 * 10/2008 Stinessen ..... F16C 33/72 417/34
2010/0043468 A1 * 2/2010 Lifson ..... F25B 41/22 62/196.3
2014/0090412 A1 * 4/2014 Fukasaku ..... F04C 29/0035 417/410.5
2015/0176585 A1 * 6/2015 Sun ..... F04C 29/128 137/493
2015/0345493 A1 * 12/2015 Lochner ..... F04C 29/128 418/55.5
2018/0202440 A1 * 7/2018 Lee ..... F04C 29/128
2019/0338773 A1 * 11/2019 Kato ..... F04C 18/02
2023/0204035 A1 * 6/2023 Lee ..... F04C 29/065 418/55.1

* cited by examiner

COMPRESSOR ASSEMBLY INCLUDING A FLOW-RESTRICTING VALVE

CROSS REFERENCE TO RELATED APPLICATION

This application claims priority to U.S. Provisional Application No. 63/279,781, which was filed on Nov. 16, 2021.

BACKGROUND

Compressors have various uses including, for example, refrigerant circuits useful for refrigeration or air conditioning. A variety of compressor designs are available. One type of compressor includes magnetic bearings to facilitate rotation of the rotating components of the compressor, such as the motor shaft. Magnetic bearings can contribute to longer compressor life and less maintenance because they provide a contactless support of the rotating components.

One shortcoming of magnetic bearings is a limited ability to withstand certain aerodynamic forces. For example, during a surge or an uncontrolled shutdown, unsteady aerodynamic forces acting on the compressor components can cause the magnetic bearings to effectively lose control over the position of the motor shaft resulting contact with a touchdown bearing. When that occurs, bearing life is reduced. Additionally, when motor shaft control is lost, a bearing alarm is tripped requiring a manual reset.

SUMMARY

An illustrative example embodiment of a compressor assembly includes a compressor housing having a suction inlet and a discharge outlet. A flow restricting valve allows unrestricted fluid flow in a first direction into the housing through the suction inlet and out of the discharge outlet during a first operating condition. The flow restricting valve allows a restricted fluid flow in a second, opposite direction into the housing through the discharge outlet in a second operating condition.

In addition to one or more of the features described above, or as an alternative, the flow restricting valve includes a fluid passage and a blocking member configured to be in a first position during the first operating condition and in a second position during the second operating condition; the fluid blocking member allows the unrestricted flow through the fluid passage in the first position; and the fluid blocking member partially blocks the passage in the second position to allow the restricted fluid flow through the passage during the second operating condition.

In addition to one or more of the features described above, or as an alternative, the fluid blocking member includes at least one hole through which some fluid may flow past the blocking member and through the passage when the fluid blocking member is in the second position.

In addition to one or more of the features described above, or as an alternative, the fluid blocking member comprises a flap.

In addition to one or more of the features described above, or as an alternative, the flap comprises a disk; the disk is supported by an arm adjacent the disk; and the at least one hole is aligned with the arm such that at least some fluid flowing through the at least one hole encounters the arm before continuing through the passage in the second direction.

In addition to one or more of the features described above, or as an alternative, the passage includes a surface that the fluid blocking member is at least partially received against in the second position; and at least one of the surface or the fluid blocking member includes a feature that prevents a complete seal from being established between the surface and the fluid blocking member in the second position.

In addition to one or more of the features described above, or as an alternative, the restricted fluid flow is between 5% and 15% of the unrestricted fluid flow.

In addition to one or more of the features described above, or as an alternative, the restricted fluid flow is between 5% and 10% of the unrestricted fluid flow.

In addition to one or more of the features described above, or as an alternative, the restricted fluid flow is about 12.5% of the unrestricted fluid flow.

In addition to one or more of the features described above, or as an alternative, the restricted fluid flow is less than 10% of the unrestricted fluid flow.

In addition to one or more of the features described above, or as an alternative, the compressor assembly includes at least one rotating component within the housing; and at least one magnetic bearing that supports the at least one rotating component in a manner that facilitates rotation of the at least one rotating component.

An illustrative example embodiment of a method of controlling fluid flow through a compressor housing having a suction inlet and a discharge outlet includes: allowing unrestricted fluid flow in a first direction into the housing through the suction inlet and out of the discharge outlet during a first operating condition; and allowing a restricted fluid flow in a second, opposite direction into the housing through the discharge outlet in a second operating condition.

In addition to one or more of the features described above, or as an alternative, the compressor housing contains rotating compressor components and a magnetic bearing that facilitates rotation of the rotating compressor components.

In addition to one or more of the features described above, or as an alternative, the method includes placing a flow restricting valve in a position to control fluid flow through the discharge outlet; opening the flow restricting valve during the first operating condition; and at least partially closing the flow restricting valve during the second condition.

In addition to one or more of the features described above, or as an alternative, the restricted fluid flow is between 5% and 10% of the unrestricted fluid flow.

The various features and advantages of at least one disclosed example embodiment will become apparent to those skilled in the art from the following detailed description. The drawings that accompany the detailed description can be briefly described as follows.

DETAILED DESCRIPTION

Figure 1:
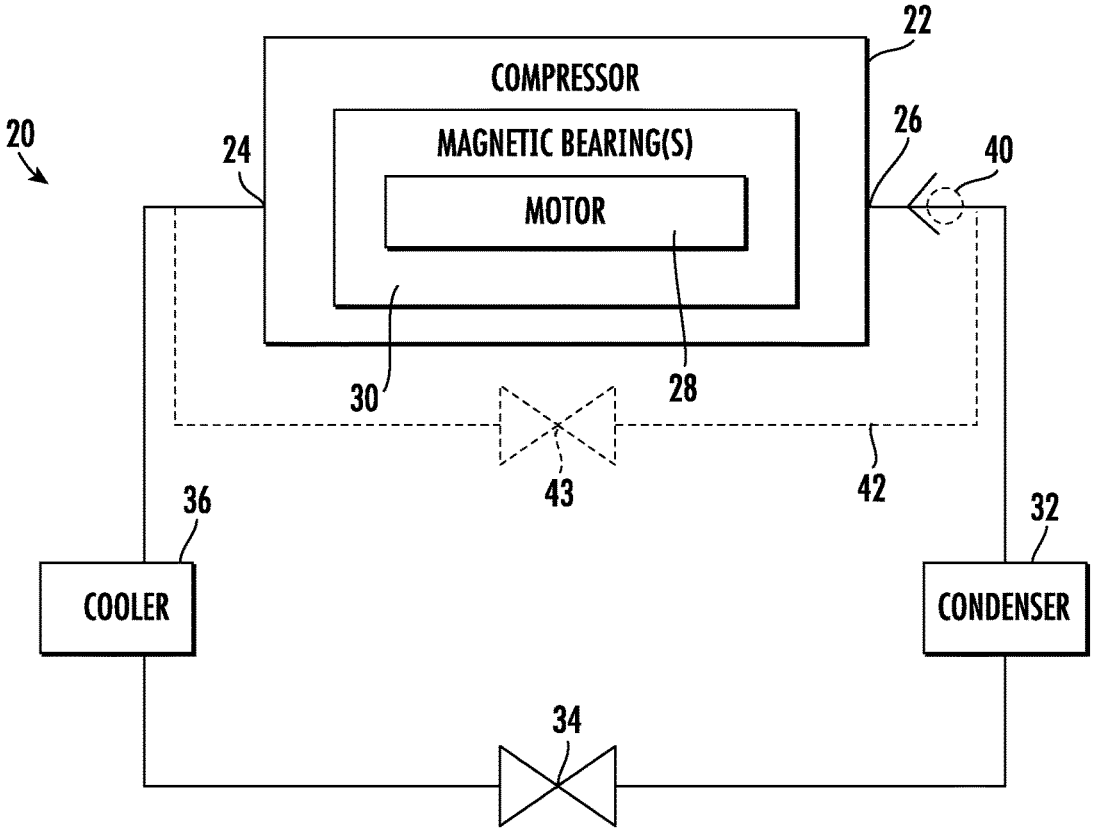
FIG. 1 schematically shows an example embodiment of a refrigeration circuit including a flow restricting valve.

FIG. 1 schematically shows a refrigeration circuit 20. A compressor 22 includes a housing having a suction inlet 24 and a discharge outlet 26. The compressor 22 includes known rotating components that are driven by a motor 28. At least one magnetic bearing 30 is associated with the rotating components, such as a shaft of the motor 28, to facilitate rotation within the housing of the compressor 22.

The refrigeration circuit 20 includes a condenser 22, an expansion valve 34 and a cooler 36. The compressor 22, condenser 32, expansion valve 34, and cooler 36 each operate in a generally known manner.

A flow restricting valve 40 is configured to allow unrestricted fluid flow in a first direction into the housing of the compressor 22 through the suction inlet 24 and out of the discharge outlet 26 in a first operating condition, which corresponds to normal or desired operation of the refrigeration circuit 20. In other words, the flow restricting valve 40 does not hinder the flow of fluid, such as refrigerant, within the circuit 20 in a first operating condition. The flow restricting valve is also configured to allow restricted flow in second, opposite direction into the compressor 22 through the discharge outlet 26 in a second, different operating condition.

One example of such a second operating condition occurs immediately after a shutdown of the compressor 22. For example, immediately after some types of compressor shutdown, a significant pressure difference exists between the cooler 36 and the condenser 32. The circuit 20 will tend toward equilibrium and the higher pressure in the condenser 32 will force fluid back toward the cooler 36, which is at a lower pressure. Since the compressor 22 is in the pathway between the condenser 32 and the cooler 36, the fluid will flow into the discharge outlet 26 and through the compressor 22. The flow restricting valve 40 controls such fluid flow and only allows a restricted amount of fluid flow into the housing of the compressor 22 through the discharge outlet 26 under such conditions. The refrigeration circuit 20 includes a hot gas bypass path 42 through which the fluid may flow as the pressures in the condenser 32 and cooler 36 equalize. A valve 43 controls whether fluid can flow through the bypass path 42. The valve 43 remains closed during normal operation of the refrigeration circuit 20. The valve 43 is opened during conditions that may result in undesired backflow through the compressor 22.

The flow restricting valve 40 remains fully open during the first operating condition to allow unrestricted fluid flow into the suction inlet 24 and out of the discharge outlet 26. The flow restricting valve 40 allows some, restricted flow into the discharge outlet 26 and through the compressor 22 during the second operating condition. Completely cutting off such fluid flow at shutdown might be desirable from one perspective, however, a valve that would do so introduces other potential complications.

The flow restricting valve 40 operates like a modified check valve. A typical check valve allows flow in only one direction. The flow restricting valve 40 allows unrestricted flow in one direction and at least some, restricted flow in an opposite direction.

If the flow restricting valve 40 were designed to completely close off or prevent flow in one of two directions through the valve, that could result in a rapid change in flow through the compressor 22 during surge, for example. Such a change is undesirable because it imparts an impulsive force within the compressor 22 that tends to cause the magnetic bearing 30 to lose control over the position of at least the shaft of the motor 28. Allowing some, restrictive flow through the flow restricting valve 40 dampens or reduces such a rapid change in fluid flow through the compressor 22.

The flow restricting valve 40, therefore, allows at least some flow in each of two directions. Controlling the amount of flow in the second direction into the discharge outlet 26 of the compressor 26 as the circuit 20 equilibrates avoids an amount of flow in the second direction that would otherwise cause reverse rotation of the rotating components of the compressor 22 at a speed that may cause the magnetic bearing 30 to lose control over the position of the shaft of the motor 28. Some fluid may flow in the second direction into the discharge outlet 26 and through the compressor, even at a level that results in reverse rotation of the rotating components in the compressor 22, provided that such flow is not enough to introduce sufficient aerodynamic forces to overcome the position control provided by the magnetic bearing 30.

The flow restricting valve 40 strikes a balance between the need to avoid impact forces within the compressor 22 under some conditions, such as surge, and the need to prevent significant backward flow through the compressor 22 under other conditions. The flow restricting valve 40 may be considered a modified or partial check valve.

Figure 2:
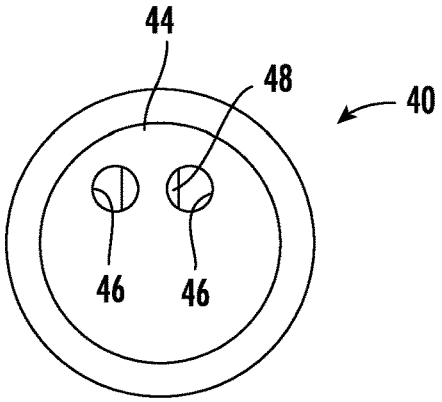
FIG. 2 shows an example configuration of selected portions of a flow restricting valve.
Figure 3:
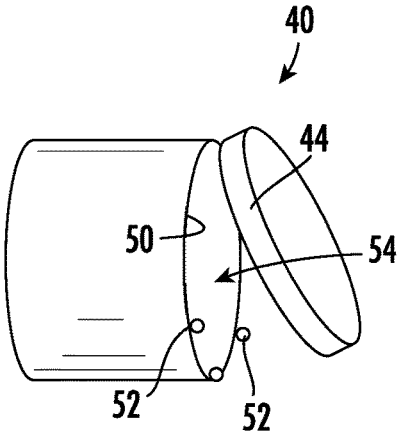
FIG. 3 shows another example configuration of selected portions of a flow restricting valve.

As shown in FIGS. 2 and 3, the flow restricting valve 40 in some embodiments includes a fluid blocking member 44, such as a flap or disk, that moves between an open position and a flow restricting position. One example fluid blocking member 44 is shown in FIG. 2. In this example, the fluid blocking member 44 comprises a disk that selectively moves into a position to close off a passage through the flow restricting valve 40. The disk 44 includes at least one opening or hole 46 through the disk. Some fluid may flow through such a hole 46, past the disk 44 and through the valve 40 toward the discharge outlet 26 even when the disk 44 is in a closed position.

In the example of FIG. 2, a plurality of holes 46 are situated relative to a support arm 48, which supports the disk 44 in the open and closed positions, so that the support arm 48 is in a pathway of fluid flowing through the holes 46. In other words, at least some of the fluid that is allowed to flow through the openings 46 encounters the support arm 48 in this example embodiment. The size of the holes combined with the overlap of the support arm 48 provides a desired restricted flow rate through the valve 40 in the second direction. The holes 46 also provide a damping effect during a surge compared to that which would result if the disk 44 did not include any holes 46.

FIG. 3 schematically illustrates another example arrangement of a disk-shaped fluid blocking member 44 and a surface 50 that the disk 44 is received against in a closed position. In this example, at least one of the disk 44 or the surface 50 includes at least one feature 52 that prevents the disk 44 from establishing a complete seal along the surface 50 when the disk 44 is in the closed position. At least some restricted fluid flow is allowed to pass through the passage 54 when the disk 44 is in a closed position because the features 52 maintain some spacing between a corresponding portion of the surface 50 and the adjacent face of the disk 44.

Whether the fluid blocking member 44 includes at least one hole or is prevented from establishing a seal against flow in the second direction, the restricted fluid flow is a relatively low percentage of flow compared to that permitted through the flow restricting valve 40 in the first operating condition when the valve is fully open. A restricted flow that is up to 15% of the flow when the valve is open is useful in some example embodiments. Restricting the flow in a second operating condition, such as immediately after a shutdown, to a limit between 5% and 15% of the unrestricted fluid flow accommodates some fluid flow through the compressor 22 while avoiding reverse rotation at an undesirably high speed. In some embodiments, the restricted fluid flow is kept between 5% and 10% of the unrestricted fluid flow based on the configuration of the flow restricting valve 40. In one example embodiment, the restricted fluid flow is about 12.5% of the unrestricted fluid flow. Some embodiments include maintaining the restricted fluid flow less than 10% of the unrestricted fluid flow provided that at least some flow is allowed.

The way in which the flow restricting valve 40 allows at least some restricted flow in two, opposite directions reduces the severity of flow interruption through the valve 40 and the compressor 22 during surge as the valve 40 transitions between closed and open positions. This improves the stability of the magnetic bearing 30 during surge conditions. Moderating the rate at which refrigerant can flow backward through the compressor 22 following an unpowered shutdown, for example, reduces a maximum reverse rotation speed of rotating components of the compressor 22. Keeping reverse rotation speeds within desired limits avoids conditions that would overcome the ability of the magnetic bearing to maintain control over the position of the shaft of the motor 28.

Controlling fluid flow through the compressor in a manner consistent with that described above increases bearing life and reduces the frequency of compressor maintenance, both of which contribute to longer-lasting and more reliable compressor performance.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A compressor assembly, comprising:

a compressor housing having a first end and a second end opposite of the first end, the compressor housing including a suction inlet at the first end and a discharge outlet at the second end;

a compressor positioned within the compressor housing and comprising at least one rotating component positioned within the compressor housing between the suction inlet and the discharge outlet, and at least one magnetic bearing that supports the at least one rotating component in a manner that facilitates rotation of the at least one rotating component;

a flow restricting valve that is configured to allow an unrestricted fluid flow in a first direction into the compressor housing through the suction inlet and out of the discharge outlet during a first operating condition and to allow a restricted fluid flow in a second, opposite direction into the compressor housing through the discharge outlet in a second operating condition, and wherein the flow restricting valve is positioned within a refrigeration circuit between the discharge outlet and a condenser;

wherein the first operating condition corresponds to a normal or desired operation of the refrigeration circuit where the flow restricting valve is configured to allow the unrestricted fluid flow in the first direction into the compressor housing through the suction inlet and out of the discharge outlet;

wherein the second operating condition occurs immediately after a shutdown of the compressor, and wherein during the second operating condition the flow restricting valve is configured to only allow the restricted fluid flow into the compressor housing of the compressor through the discharge outlet;

wherein the flow restricting valve is external to the compressor housing and is immediately downstream of the discharge outlet when operating in the first operating condition;

wherein the flow restricting valve is immediately upstream of the discharge outlet when operating in the second operating condition;

wherein the condenser is immediately downstream of the flow restricting valve when operating in the first operating condition; and wherein the refrigeration circuit includes a bypass path through which the fluid may flow as pressures in the condenser and cooler equalize, and including a valve configured to control whether fluid can flow through the bypass path, wherein the valve remains closed during the first operating condition, and wherein the valve is opened during conditions that may result in undesired backflow through the compressor during the second operating condition.

2. The compressor assembly of claim 1, wherein the flow restricting valve includes a fluid passage and a blocking member configured to be in a first position during the first operating condition and in a second position during the second operating condition;

the blocking member allows the unrestricted flow through the fluid passage in the first position; and the blocking member partially blocks the fluid passage in the second position to allow the restricted fluid flow through the fluid passage during the second operating condition.

3. The compressor assembly of claim 2, wherein the blocking member includes at least one hole through which some fluid may flow past the blocking member and through the fluid passage when the blocking member is in the second position.

4. The compressor assembly of claim 3, wherein the blocking member comprises a flap.

5. The compressor assembly of claim 4, wherein the flap comprises a disk;

the disk is supported by an arm adjacent the disk; and the at least one hole is aligned with the arm such that at least some fluid flowing through the at least one hole encounters the arm before continuing through the fluid passage in the second direction.

6. The compressor assembly of claim 2, wherein the fluid passage includes a surface that the blocking member is at least partially received against in the second position; and at least one of the surface or the blocking member includes a feature that prevents a complete seal from being established between the surface and the blocking member in the second position.

7. The compressor assembly of claim 1, wherein the restricted fluid flow is between 5% and 15% of the unrestricted fluid flow.

8. The compressor assembly of claim 7, wherein the restricted fluid flow is between 5% and 10% of the unrestricted fluid flow.

9. The compressor assembly of claim 7, wherein the restricted fluid flow is about 12.5% of the unrestricted fluid flow.

10. A method of controlling fluid flow through a compressor housing having a first end and a second end opposite of the first end, the compressor housing having a suction inlet at the first end and a discharge outlet at the second end, the method comprising:

providing a refrigeration circuit including at least a condenser, an expansion valve, a cooler, and a compressor;

positioning the compressor within the compressor housing, the compressor comprising at least one rotating component positioned within the compressor housing between the suction inlet and the discharge outlet, and at least one magnetic bearing that supports the at least one rotating component in a manner that facilitates rotation of the at least one rotating component;

placing a flow restricting valve in a position to control fluid flow through the discharge outlet, wherein the position is between the discharge outlet of the compressor housing and the condenser;

allowing an unrestricted fluid flow in a first direction during a first operating condition, wherein the first operating condition corresponds to a normal or desired operation of the refrigeration circuit where the flow restricting valve is configured to allow the unrestricted fluid flow in the first direction into the compressor housing through the suction inlet and out of the discharge outlet;

allowing a restricted fluid flow in a second, opposite direction during a second operating condition, wherein the second operating condition occurs immediately after a shutdown of the compressor, and wherein during the second operating condition the flow restricting valve is configured to only allow a restricted amount of fluid flow into the compressor housing of the compressor through the discharge outlet;

wherein the flow restricting valve is external to the compressor housing and is immediately downstream of the discharge outlet when operating in the first operating condition;

wherein the flow restricting valve is immediately upstream of the discharge outlet when operating in the second operating condition, and wherein the condenser is immediately downstream of the flow restricting valve when operating in the first operating condition; and wherein the refrigeration circuit includes a bypass path through which the fluid may flow as pressures in the condenser and cooler equalize, and including a valve configured to control whether fluid can flow through the bypass path, wherein the valve remains closed during the first operating condition, and wherein the valve is opened during conditions that may result in undesired backflow through the compressor during the second operating condition, and wherein the bypass path has a first connection to the refrigeration circuit at a location between the flow restricting valve and the condenser, and has a second connection to the refrigeration circuit at a location between a cooler and the suction inlet.

11. The method of claim 10, comprising opening the flow restricting valve during the first operating condition; and at least partially closing the flow restricting valve during the second operating condition.

12. The method of claim 10, wherein the restricted fluid flow is between 5% and 10% of the unrestricted fluid flow.

13. The method of claim 10, wherein the flow restricting valve includes a fluid passage and a blocking member configured to be in a first position during the first operating condition and in a second position during the second operating condition, and including:

the blocking member allowing the unrestricted flow through the fluid passage in the first position; and the blocking member partially blocking the fluid passage in the second position to allow the restricted fluid flow through the fluid passage during the second operating condition.

14. The method of claim 13, including providing a support arm associated with the blocking member that is positioned in the fluid passage for fluid flowing through the flow restricting valve.

15. The compressor assembly of claim 2, including a support arm associated with the blocking member, the support arm being positioned in the fluid passage of fluid flowing through the flow restricting valve.

16. The compressor assembly of claim 1, wherein the bypass path has a first connection to the refrigeration circuit at a location between the flow restricting valve and the condenser, and has a second connection to the refrigeration circuit at a location between a cooler and the suction inlet.

17. The compressor assembly of claim 16, wherein, during the first operating condition, the first connection is immediately downstream of the flow restricting valve and the second connection is immediately upstream of the suction inlet.

18. The compressor assembly of claim 1, wherein the discharge outlet discharges fluid out of the compressor housing and directly into the refrigeration circuit when operating in the first operating condition.

19. The compressor assembly of claim 18, wherein the suction inlet directly receives fluid from the refrigeration circuit and directs fluid into the compressor housing when operating in the first operating condition.

20. The method of claim 10, wherein the discharge outlet discharges fluid out of the compressor housing and directly into the refrigeration circuit when operating in the first operating condition.

21. A compressor assembly, comprising:

a compressor housing having a suction inlet and a discharge outlet;

a compressor positioned within the compressor housing;

a flow restricting valve that is configured to allow unrestricted fluid flow in a first direction into the compressor housing through the suction inlet and out of the discharge outlet during a first operating condition and to allow a restricted fluid flow in a second, opposite direction into the compressor housing through the discharge outlet in a second operating condition, and wherein the flow restricting valve is positioned within a refrigeration circuit between the discharge outlet and a condenser;

wherein the second operating condition occurs immediately after a shutdown of the compressor, and wherein during the second operating condition the flow restricting valve is configured to only allow the restricted fluid flow into the compressor housing of the compressor through the discharge outlet; and wherein the refrigeration circuit includes a bypass path through which the fluid may flow as pressures in the condenser and cooler equalize, and including a valve configured to control whether fluid can flow through the bypass path, wherein the valve remains closed during the first operating condition, and wherein the valve is opened during conditions that may result in undesired backflow through the compressor during the second operating condition.

* * * * *